US011386878B2

(12) United States Patent
Wang et al.

(10) Patent No.: US 11,386,878 B2
(45) Date of Patent: Jul. 12, 2022

(54) BROADBAND ULTRATHIN SOUND ABSORPTION OR SOUND INSULATION STRUCTURE CONTROLLING AN ACOUSTIC WAVE PROPAGATION PATH

(71) Applicant: Dalian University of Technology, Dalian (CN)

(72) Inventors: Xiaoming Wang, Dalian (CN); Yulin Mei, Dalian (CN); Yixuan Mei, Dalian (CN)

(73) Assignee: DALIAN UNIVERSITY OF TECHNOLOGY, Dalian (CN)

( * ) Notice: Subject to any disclaimer, the term of this patent is extended or adjusted under 35 U.S.C. 154(b) by 416 days.

(21) Appl. No.: 16/487,405

(22) PCT Filed: Apr. 26, 2017

(86) PCT No.: PCT/CN2017/082073

§ 371 (c)(1),
(2) Date: Aug. 20, 2019

(87) PCT Pub. No.: WO2018/195836

PCT Pub. Date: Nov. 1, 2018

(65) Prior Publication Data

US 2019/0378490 A1 Dec. 12, 2019

(51) Int. Cl.

| | |
|---|---|
| ***G10K 11/168*** | (2006.01) |
| ***G10K 11/00*** | (2006.01) |
| ***E04B 1/84*** | (2006.01) |

(52) U.S. Cl.

CPC ..... *G10K 11/168* (2013.01); *G10K 11/002* (2013.01); *E04B 1/84* (2013.01)

(58) Field of Classification Search

CPC .... G10K 11/162; G10K 11/168; G10K 11/20; G10K 11/002

(Continued)

(56) References Cited

U.S. PATENT DOCUMENTS 3,693,750 A * 9/1972 Takkunen ..... B32B 15/043 428/558
7,520,369 B2 * 4/2009 Dravet ..... B64D 29/00 181/284

(Continued)

FOREIGN PATENT DOCUMENTS

CN 102251829 A 11/2011
CN 202473219 U 10/2012

(Continued)

*Primary Examiner* — Forrest M Phillips

(74) *Attorney, Agent, or Firm* — Muncy, Geissler, Olds & Lowe, P.C.

(57) ABSTRACT

A broadband ultrathin sound absorption or sound insulation structure controlling an acoustic wave propagation path has at least one sound absorption unit or one sound insulation unit; and each sound absorption unit or sound insulation unit has at least one acoustic wave focused section and at least one acoustic wave absorption section. The acoustic wave focused section is formed by an acoustic wave focused cavity filled with acoustic material. The acoustic wave focused section controls the acoustic wave propagation path through the change of a section of the cavity and the change of material equivalent parameters in the cavity, so that the acoustic waves are focused and propagate along the curve. The acoustic wave absorption section realizes efficient broadband sound absorption through the filled sound absorption materials and the arranged periodic local oscillators along an ultralong path of acoustic wave absorption labyrinth passage.

18 Claims, 3 Drawing Sheets

(58) Field of Classification Search
USPC ..... 181/286
See application file for complete search history.

(56) References Cited

U.S. PATENT DOCUMENTS

| | | | | |
|---|---|---|---|---|
| 11,164,559 | B2 * | 11/2021 | Lee | G10K 11/162 |
| 2010/0089691 | A1 * | 4/2010 | Nakamura | B60R 13/011 181/286 |
| 2012/0024624 | A1 * | 2/2012 | Reigner | H04R 7/045 181/284 |
| 2016/0063984 | A1 * | 3/2016 | Kosonen | C08J 5/045 252/62 |

FOREIGN PATENT DOCUMENTS

| | | | |
|---|---|---|---|
| CN | 106382432 | A | 2/2017 |
| CN | 206055918 | U | 3/2017 |
| CN | 106952640 | A | 7/2017 |
| CN | 206741932 | U | 12/2017 |
| FR | 2770734 | A1 | 5/1999 |
| SU | 868070 | A1 | 9/1981 |
| SU | 1420198 | A1 | 8/1988 |

* cited by examiner

BROADBAND ULTRATHIN SOUND ABSORPTION OR SOUND INSULATION STRUCTURE CONTROLLING AN ACOUSTIC WAVE PROPAGATION PATH

TECHNICAL FIELD

The present invention belongs to the technical field of noise reduction, and relates to the broadband ultrathin sound absorption or sound insulation structure controlling an acoustic wave propagation path.

BACKGROUND

At present, the sound absorption or sound insulation structure has a common problem that under the condition of strictly limiting the structural size and weight, the structure has good sound absorption or insulation effects generally in medium frequency band and high frequency band but has poor sound absorption or insulation effects at low frequency band. If the lower limit of sound absorption or insulation cut-off frequency is extended to be below 100 Hz, and the performance of broadband sound absorption or insulation is also taken into account, the design will be very difficult. To solve this problem, the present invention discloses a broadband ultrathin sound absorption or sound insulation structure controlling an acoustic wave propagation path, which is designed based on the new theories developed in recent years such as transformation acoustics theory, acoustic metamaterial and phononic crystals.

SUMMARY

The present invention adopts the following technical solution:

A broadband ultrathin sound absorption or sound insulation structure controlling an acoustic wave propagation path comprises at least one sound absorption unit or sound insulation unit; and each sound absorption unit or sound insulation unit comprises at least one acoustic wave focused section and at least one acoustic wave absorption section.

The acoustic wave focused section is formed by a through cavity filled with acoustic material. The through cavity has variable section, and isotropic or anisotropic acoustic material is filled in the variable-section cavity. The anisotropic acoustic material is formed by embedding membranes or string nets into the isotropic acoustic material.

The acoustic wave absorption section is formed by an acoustic wave absorption labyrinth passage filled with sound absorption materials. The acoustic wave absorption labyrinth passage is a labyrinth-shaped simply connected passage with a closed or open end, and the passage communicates with the through cavity of the acoustic wave focused section. In the sound absorption unit or sound insulation unit, the acoustic wave absorption labyrinth passages are designed into slender passages, are closely arranged through the measures of circuitry, bending, coiling or stacking in a monolayer or multilayer or spatial spiral structural form, and occupy the whole of available space outside the acoustic wave focused section.

Sound absorption material is filled in the acoustic wave absorption labyrinth passage of the acoustic wave absorption section, with the filling solutions as follows:

(1) the same sound absorption material is filled in the whole acoustic wave absorption labyrinth passage;

(2) the acoustic wave absorption labyrinth passage is divided into a plurality of sections, and sound absorption materials with different material parameters are filled in different sections;

(3) the acoustic wave absorption labyrinth passage is divided into a plurality of sections, and the same or different sound absorption materials are filled in each section of passage; local oscillators are also arranged in the acoustic wave absorption labyrinth passage; the local oscillators in different sections of passage have different inherent frequencies, thereby forming periodic local oscillators with multiple different inherent frequency points in the whole passage; and (4) membranes or string nets or perforated plates are arranged in the acoustic wave absorption labyrinth passage at equal interval or different intervals while the same or different sound absorption materials are filled in the acoustic wave absorption labyrinth passage.

The local oscillators are metal particles coated with soft materials or membranes partially bonded to metal sheets.

The membrane is a non-porous membrane or porous membrane, and is made of metal or nonmetallic, including cotton, fiber, silk, burlap, woolen cloth, mixture yarn and leather.

The string net is made of metal or nonmetallic.

The acoustic material or sound absorption material is gas material, solid material or liquid material, including air, helium, silicone oil, castor oil, gel, polyurethane, polyester, epoxy resin, foamed plastics, foamed metal, soft rubber, silicone rubber, sound absorption rubber, butyl rubber, glass wool, glass fiber, felt, silk, cloth and micro-perforated panels.

The broadband ultrathin sound absorption or sound insulation structure controlling an acoustic wave propagation path, disclosed by the present invention, is proposed based on the theories developed in recent years such as transformation acoustics theory, acoustic metamaterial and phononic crystals. The greatest innovation of the present invention is that the acoustic wave propagation path is controlled through the change of a section of the through cavity in the acoustic wave focused section and the change of acoustic material equivalent parameters in the cavity, and the acoustic wave is focused. Meanwhile, in the sound absorption unit or sound insulation unit, the acoustic wave absorption labyrinth passages can be designed into slender passages through the close arrangement measures of circuitry, bending, coiling or stacking in a monolayer or multilayer or spatial spiral structural form so that the acoustic wave absorption labyrinth passages occupy the whole of available space outside the acoustic wave focused section in the sound absorption unit or sound insulation unit. Thus, the acoustic wave absorption labyrinth passage has an ultralong path which is dozens or even hundreds of times of the thickness of the sound absorption or sound insulation structure. The sound absorption materials are filled in the ultralong acoustic wave absorption labyrinth passage, and periodic local oscillators are also arranged, so as to realize efficient broadband sound absorption.

In the figures: 1 acoustic wave focused section; 2 acoustic wave absorption section; 3 back wall; 4 acoustic material filled in acoustic wave focused cavity; 5 membrane or string net embedded in acoustic material; 6 communication hole between adjacent layers of laminated acoustic wave absorption labyrinth passages; 7 sound absorption material filled in acoustic wave absorption labyrinth passage; 8 wall of acoustic wave absorption labyrinth passage; 9 isolated wall between two acoustic wave absorption sections; 10 wall of acoustic wave focused cavity; 11 acoustic wave absorption labyrinth passage.

The arrow in the figure indicates the direction of propagation of the acoustic wave.

DETAILED DESCRIPTION

Figure 1:
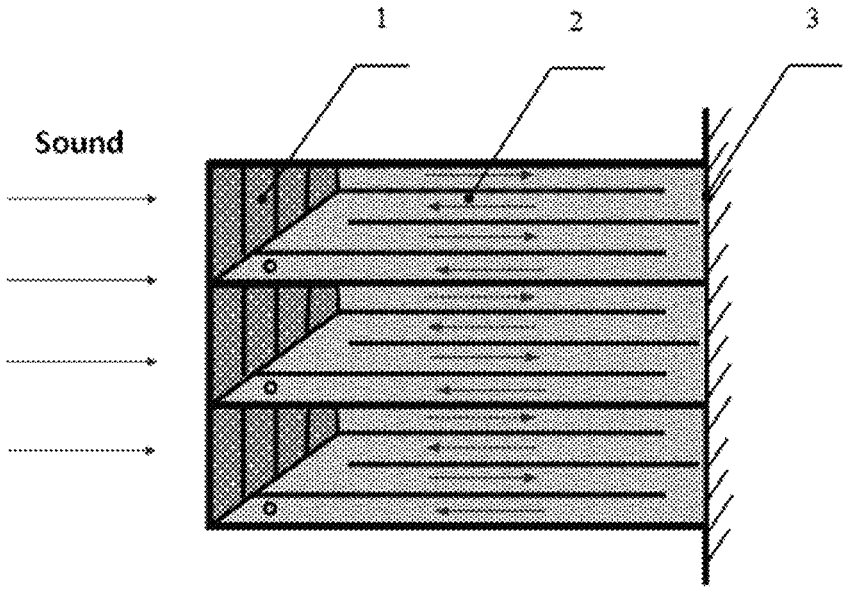
FIG. 1 is a schematic diagram of a side section of a broadband ultrathin sound absorption structure controlling an acoustic wave propagation path.

Embodiment 1: Broadband Ultrathin Sound Absorption Structure Controlling an Acoustic Wave Propagation Path A plurality of sound absorption units are arranged along the surface of a back wall 3 to form a broadband ultrathin sound absorption structure controlling an acoustic wave propagation path, as shown in FIG. 1. Each sound absorption unit comprises an acoustic wave focused section 1 and an acoustic wave absorption section 2, and its structure is shown in FIG. 3.

The acoustic wave focused section 1 is formed by an acoustic wave focused cavity filled with acoustic material. The cavity is a variable-section cavity, and has an end surface with regular hexagon. The same acoustic material 4 is filled in the cavity, and multilayer membranes 5 are embedded at equal spacing in the cavity.

Figure 3:
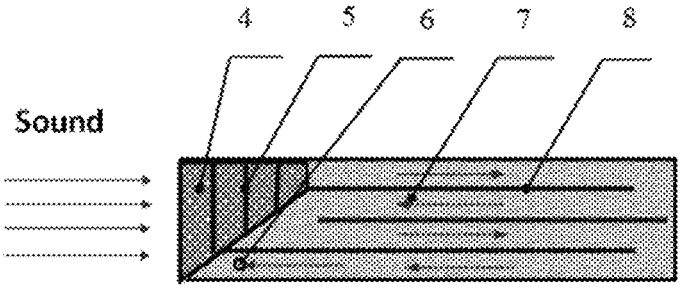
FIG. 3 is a schematic diagram of a side section of a sound absorption unit, including one acoustic wave focused section and one acoustic wave absorption section.
Figure 7:
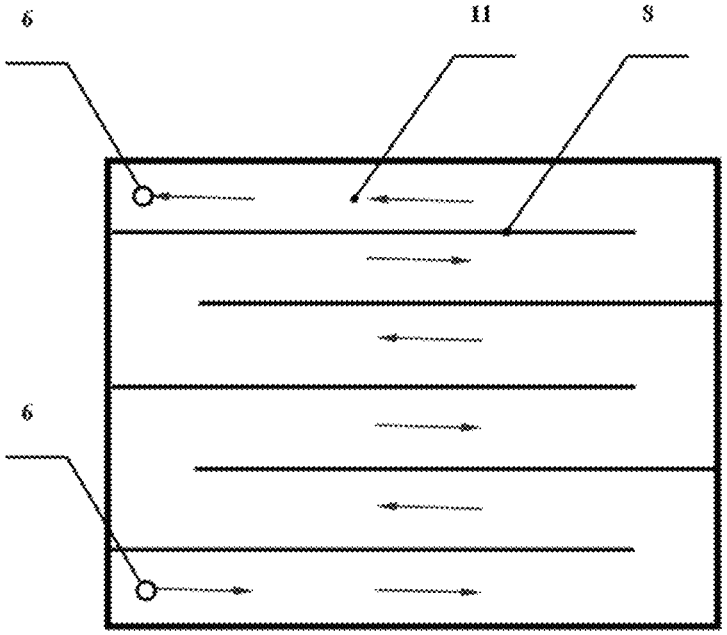
FIG. 7 is a monolayer schematic diagram of an acoustic wave absorption labyrinth passage.

The acoustic wave absorption section 2 is formed by acoustic wave absorption labyrinth passages 11 filled with sound absorption material 7, as shown in FIG. 3 and FIG. 7. The acoustic wave absorption labyrinth passage 11 is a slender simply connected passage, is arranged through the measures of circuitry, bending, coiling or stacking in the sound absorption unit, and comprises 5 layers. Adjacent layers are in communication with each other through a communication hole 6. Herein, FIG. 7 is only a monolayer schematic diagram of the acoustic wave absorption labyrinth passage 11 in the acoustic wave absorption section 2. In each sound absorption unit, the acoustic wave absorption labyrinth passage 11 occupies the whole of available space outside the acoustic wave focused section 1, and the total length is 100 times of the thickness of the sound absorption unit. The acoustic wave absorption labyrinth passage 11 is divided into 50 sections, and the sound absorption rubber is filled in each section. At the same time, local oscillators are embedded into the sound absorption rubber in different sections, and the local oscillators are formed by metal particles coated with soft rubber, and the metal particles have different sizes in the different sections.

The acoustic wave focused cavity in the acoustic wave focused section 1 communicates with the acoustic wave absorption labyrinth passage 11 in the acoustic wave absorption section 2.

First, external acoustic waves enter the acoustic wave focused section 1, and are focused through the acoustic wave focused cavity and the acoustic materials 4 and 5 filled therein. Then, the focused acoustic waves enter the acoustic wave absorption section 2, propagate in the ultralong acoustic wave absorption labyrinth passage 11 and are gradually absorbed by the sound absorption material 7.

Figure 5:
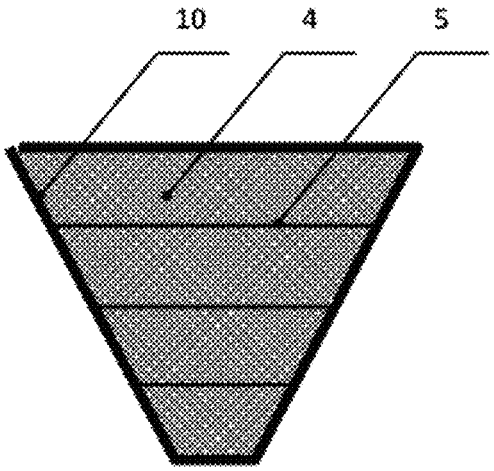
FIG. 5 is a schematic diagram of an acoustic wave focused section.
Figure 8:
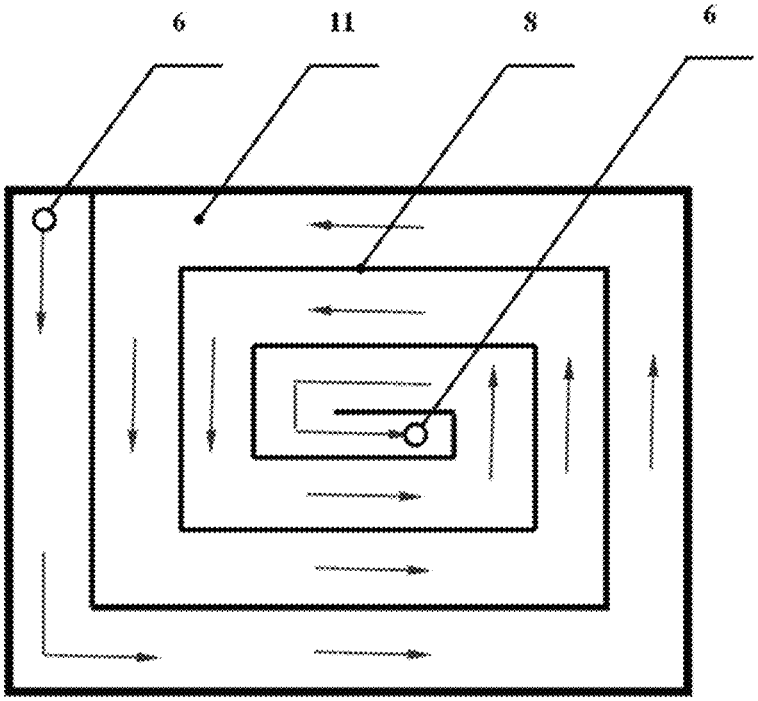
FIG. 8 is a monolayer schematic diagram of an acoustic wave absorption labyrinth passage.

Embodiment 2: Broadband Ultrathin Sound Absorption Structure Controlling an Acoustic Wave Propagation Path The present embodiment is substantially the same as embodiment 1, and is different from embodiment 1 in that: (1) the acoustic wave focused section, as shown in FIG. 5, in the sound absorption unit, has an acoustic wave focused cavity with a circular end surface. (2) The monolayer structure of the acoustic wave absorption labyrinth passage 11 in the sound absorption unit is shown in FIG. 8.

Figure 6:
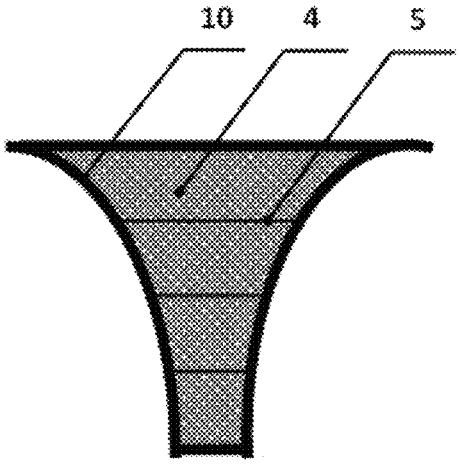
FIG. 6 is a schematic diagram of an acoustic wave focused section.
Figure 9:
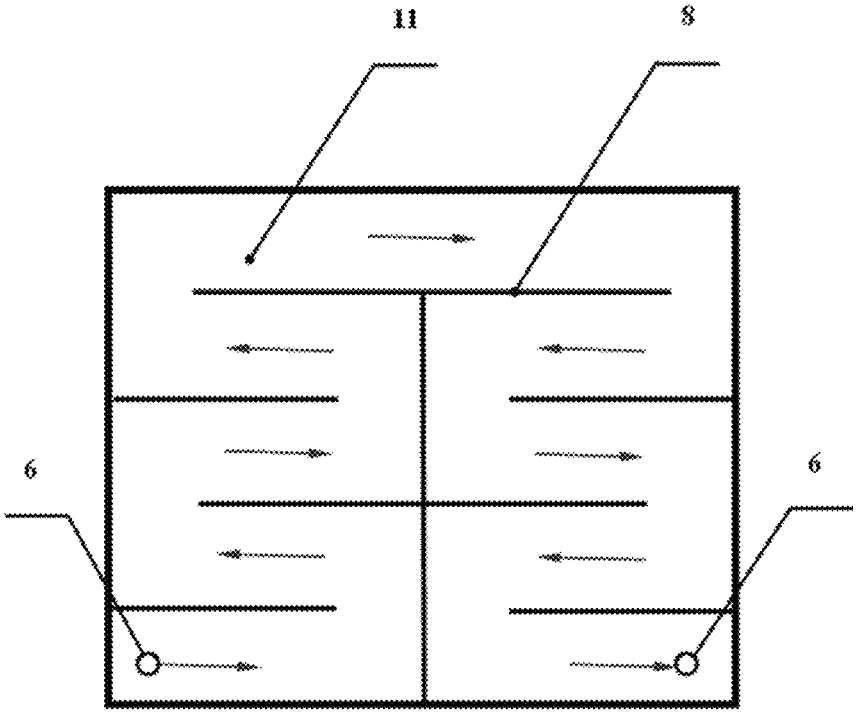
FIG. 9 is a monolayer schematic diagram of an acoustic wave absorption labyrinth passage.

Embodiment 3: Broadband Ultrathin Sound Absorption Structure Controlling an Acoustic Wave Propagation Path The present embodiment is substantially the same as embodiment 1, and is different from embodiment 1 in that: (1) the acoustic wave focused section, as shown in FIG. 6, in the sound absorption unit, has an acoustic wave focused cavity with a triangular end surface. (2) The monolayer structure of the acoustic wave absorption labyrinth passage 11 in the sound absorption unit is shown in FIG. 9.

Figure 2:
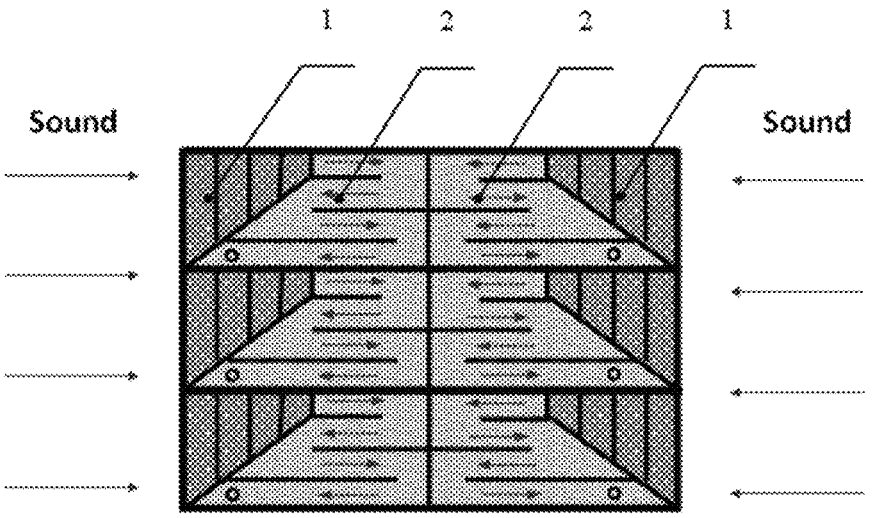
FIG. 2 is a schematic diagram of a side section of a broadband ultrathin sound insulation structure controlling an acoustic wave propagation path.

Embodiment 4: Broadband Ultrathin Sound Insulation Structure Controlling an Acoustic Wave Propagation Path A plurality of sound insulation units are periodically arranged to form a broadband ultrathin sound insulation structure controlling an acoustic wave propagation path, as shown in FIG. 2. Each sound insulation unit comprises two acoustic wave focused sections 1 and two acoustic wave absorption sections 2, and the unit structure is shown in FIG. 4.

Each acoustic wave focused section 1 is formed by an acoustic wave focused cavity filled with acoustic materials. The cavity is a variable-section cavity, and the end surface of the cavity is a square. The acoustic material 4 in the cavity is air, and multilayer silks 5 are embedded at equal spacing in the cavity.

Figure 4:
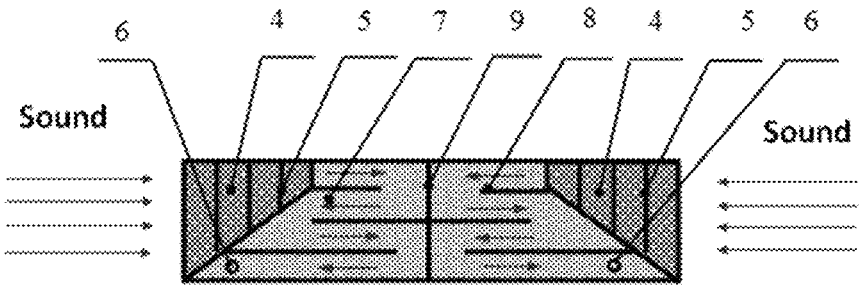
FIG. 4 is a schematic diagram of a side section of a sound insulation unit, including two acoustic wave focused sections and two acoustic wave absorption sections.

Each acoustic wave absorption section 2 is formed by the acoustic wave absorption labyrinth passage 11 filled with sound absorption material 7, as shown in FIG. 4. The acoustic wave absorption labyrinth passage 11 is a slender simply connected passage, is arranged through the measures of circuitry, bending, coiling or stacking in the sound insulation unit, and comprises 6 layers. Adjacent layers are in communication with each other through a communication hole 6.

In each sound insulation unit, the acoustic wave absorption labyrinth passages 11 of two acoustic wave absorption sections occupy the whole of available space outside two acoustic wave focused section 1, and the total length of the passages is 50 times of the thickness of the sound insulation unit. The air is filled in the acoustic wave absorption labyrinth passage 11 of each acoustic wave absorption section, and membranes partially bonded to metal sheets are arranged at a certain spacing in the acoustic wave absorption labyrinth passages 11.

The acoustic wave focused cavity in the acoustic wave focused section 1 communicates with the acoustic wave absorption labyrinth passage 11 in the corresponding acoustic wave absorption section 2.

First, acoustic waves from both sides enter the acoustic wave focused sections 1 on both sides, and are focused by the acoustic wave focused cavities and the acoustic materials 4 and 5 filled therein. Then, the focused acoustic waves enter the acoustic wave absorption sections 2, and propagate in the acoustic wave absorption labyrinth passages 11. The acoustic waves are gradually absorbed by the sound absorption material 7, and the sound insulation is realized.

Embodiment 5: Broadband Ultrathin Sound Insulation Structure Controlling an Acoustic Wave Propagation Path The main difference between the present embodiment and embodiment 4 is: each sound insulation unit comprises two acoustic wave focused sections 1 and one acoustic wave absorption section 2. The acoustic wave focused section, as shown in FIG. 6, has an acoustic wave focused cavity with a rectangular end surface. Material 4 filled in the cavity is the general acoustic material, and multilayer string nets 5 are embedded at different spacings in the cavity. The monolayer structure of the acoustic wave absorption labyrinth passage 11 is shown in FIG. 7. At this point, the acoustic waves from both sides of the sound insulation unit share one acoustic wave absorption labyrinth passage 11, and an inlet of the acoustic wave at one side is an outlet of the acoustic wave at the other side.

The invention claimed is:

1. A broadband ultrathin sound absorption or sound insulation structure controlling an acoustic wave propagation path, comprising at least one sound absorption unit or sound insulation unit, wherein each sound absorption unit or sound insulation unit comprises at least one acoustic wave focused section and at least one acoustic wave absorption section;

each acoustic wave focused section is formed by an acoustic wave focused cavity filled with acoustic material; the acoustic wave focused cavity is a variable-section cavity, and isotropic or anisotropic acoustic material is filled in the variable-section cavity; and each acoustic wave absorption section is formed by an acoustic wave absorption labyrinth passage filled with sound absorption materials; the acoustic wave absorption labyrinth passage is a labyrinth-shaped simply connected passage with a closed or open end, and the passage communicates with the acoustic wave focused cavity of the acoustic wave focused section; in each sound absorption unit or sound insulation unit, the acoustic wave absorption labyrinth passages are closely arranged through the measures of circuitry, bending, coiling or stacking in a monolayer or multilayer or spatial spiral structural form, and occupy whole of available space outside the acoustic wave focused sections.

2. The broadband ultrathin sound absorption or sound insulation structure controlling an acoustic wave propagation path of claim 1, wherein the anisotropic acoustic material is formed by embedding membranes or string nets into the isotropic acoustic material.

3. The broadband ultrathin sound absorption or sound insulation structure controlling an acoustic wave propagation path of claim 1, wherein sound absorption material is filled in the acoustic wave absorption labyrinth passage of the acoustic wave absorption section, with the filling solutions as follows:

(1) the same sound absorption material is filled in the whole acoustic wave absorption labyrinth passage;

(2) the acoustic wave absorption labyrinth passage is divided into a plurality of sections, and sound absorption materials with different material parameters are filled in different sections;

(3) the acoustic wave absorption labyrinth passage is divided into a plurality of sections, and the same or different sound absorption materials are filled in each section of passage; local oscillators are also arranged in the acoustic wave absorption labyrinth passage; the local oscillators in different sections of passage have different inherent frequencies, thereby forming periodic local oscillators with multiple different inherent frequency points in the whole passage; and (4) membranes or string nets or perforated plates are arranged in the acoustic wave absorption labyrinth passage at equal interval or different intervals while the same or different sound absorption materials are filled in the acoustic wave absorption labyrinth passage.

4. The broadband ultrathin sound absorption or sound insulation structure controlling an acoustic wave propagation path of claim 2, wherein sound absorption material is filled in the acoustic wave absorption labyrinth passage of the acoustic wave absorption section, with the filling solutions as follows:

(1) the same sound absorption material is filled in the whole acoustic wave absorption labyrinth passage;

(2) the acoustic wave absorption labyrinth passage is divided into a plurality of sections, and sound absorption materials with different material parameters are filled in different sections;

(3) the acoustic wave absorption labyrinth passage is divided into a plurality of sections, and the same or different sound absorption materials are filled in each section of passage; local oscillators are also arranged in the acoustic wave absorption labyrinth passage; the local oscillators in different sections of passage have different inherent frequencies, thereby forming periodic local oscillators with multiple different inherent frequency points in the whole passage; and (4) membranes or string nets or perforated plates are arranged in the acoustic wave absorption labyrinth passage at equal interval or different intervals while the same or different sound absorption materials are filled in the acoustic wave absorption labyrinth passage.

5. The broadband ultrathin sound absorption or sound insulation structure controlling an acoustic wave propagation path of claim 4, wherein the local oscillators are metal particles coated with soft materials or membranes partially bonded to metal sheets.

6. The broadband ultrathin sound absorption or sound insulation structure controlling an acoustic wave propagation path of claim 3, wherein the local oscillators are metal particles coated with soft materials or membranes partially bonded to metal sheets.

7. The broadband ultrathin sound absorption or sound insulation structure controlling an acoustic wave propagation path of claim 2, wherein the membrane is a non-porous membrane or porous membrane, and is made of metal or nonmetallic, including cotton, fiber, silk, burlap, woolen cloth, mixture yarn and leather; and the string net is made of metal or nonmetallic.

8. The broadband ultrathin sound absorption or sound insulation structure controlling an acoustic wave propagation path of claim 4, wherein the membrane is a non-porous membrane or porous membrane, and is made of metal or nonmetallic, including cotton, fiber, silk, burlap, woolen cloth, mixture yarn and leather; and the string net is made of metal or nonmetallic.

9. The broadband ultrathin sound absorption or sound insulation structure controlling an acoustic wave propagation path of claim 5, wherein the membrane is a non-porous membrane or porous membrane, and is made of metal or nonmetallic, including cotton, fiber, silk, burlap, woolen cloth, mixture yarn and leather; and the string net is made of metal or nonmetallic.

10. The broadband ultrathin sound absorption or sound insulation structure controlling an acoustic wave propagation path of claim 1, wherein the acoustic material or sound absorption material is gas material, solid material or liquid material, including air, helium, silicone oil, castor oil, gel, polyurethane, polyester, epoxy resin, foamed plastics, foamed metal, soft rubber, silicone rubber, sound absorption rubber, butyl rubber, glass wool, glass fiber, felt, silk, cloth and micro-perforated panels.

11. The broadband ultrathin sound absorption or sound insulation structure controlling an acoustic wave propagation path of claim 2, wherein the acoustic material or sound absorption material is gas material, solid material or liquid material, including air, helium, silicone oil, castor oil, gel, polyurethane, polyester, epoxy resin, foamed plastics, foamed metal, soft rubber, silicone rubber, sound absorption rubber, butyl rubber, glass wool, glass fiber, felt, silk, cloth and micro-perforated panels.

12. The broadband ultrathin sound absorption or sound insulation structure controlling an acoustic wave propagation path of claim 3, wherein the acoustic material or sound absorption material is gas material, solid material or liquid material, including air, helium, silicone oil, castor oil, gel, polyurethane, polyester, epoxy resin, foamed plastics, foamed metal, soft rubber, silicone rubber, sound absorption rubber, butyl rubber, glass wool, glass fiber, felt, silk, cloth and micro-perforated panels.

13. The broadband ultrathin sound absorption or sound insulation structure controlling an acoustic wave propagation path of claim 4, wherein the acoustic material or sound absorption material is gas material, solid material or liquid material, including air, helium, silicone oil, castor oil, gel, polyurethane, polyester, epoxy resin, foamed plastics, foamed metal, soft rubber, silicone rubber, sound absorption rubber, butyl rubber, glass wool, glass fiber, felt, silk, cloth and micro-perforated panels.

14. The broadband ultrathin sound absorption or sound insulation structure controlling an acoustic wave propagation path of claim 5, wherein the acoustic material or sound absorption material is gas material, solid material or liquid material, including air, helium, silicone oil, castor oil, gel, polyurethane, polyester, epoxy resin, foamed plastics, foamed metal, soft rubber, silicone rubber, sound absorption rubber, butyl rubber, glass wool, glass fiber, felt, silk, cloth and micro-perforated panels.

15. The broadband ultrathin sound absorption or sound insulation structure controlling an acoustic wave propagation path of claim 6, wherein the acoustic material or sound absorption material is gas material, solid material or liquid material, including air, helium, silicone oil, castor oil, gel, polyurethane, polyester, epoxy resin, foamed plastics, foamed metal, soft rubber, silicone rubber, sound absorption rubber, butyl rubber, glass wool, glass fiber, felt, silk, cloth and micro-perforated panels.

16. The broadband ultrathin sound absorption or sound insulation structure controlling an acoustic wave propagation path of claim 7, wherein the acoustic material or sound absorption material is gas material, solid material or liquid material, including air, helium, silicone oil, castor oil, gel, polyurethane, polyester, epoxy resin, foamed plastics, foamed metal, soft rubber, silicone rubber, sound absorption rubber, butyl rubber, glass wool, glass fiber, felt, silk, cloth and micro-perforated panels.

17. The broadband ultrathin sound absorption or sound insulation structure controlling an acoustic wave propagation path of claim 8, wherein the acoustic material or sound absorption material is gas material, solid material or liquid material, including air, helium, silicone oil, castor oil, gel, polyurethane, polyester, epoxy resin, foamed plastics, foamed metal, soft rubber, silicone rubber, sound absorption rubber, butyl rubber, glass wool, glass fiber, felt, silk, cloth and micro-perforated panels.

18. The broadband ultrathin sound absorption or sound insulation structure controlling an acoustic wave propagation path of claim 9, wherein the acoustic material or sound absorption material is gas material, solid material or liquid material, including air, helium, silicone oil, castor oil, gel, polyurethane, polyester, epoxy resin, foamed plastics, foamed metal, soft rubber, silicone rubber, sound absorption rubber, butyl rubber, glass wool, glass fiber, felt, silk, cloth and micro-perforated panels.

* * * * *